United States Patent [19]

Gomes et al.

[11] 4,208,275

[45] Jun. 17, 1980

[54] FROTH FLOTATION USING LANOLIN MODIFIER

[75] Inventors: John M. Gomes; Daniel A. O'Keefe, both of Reno; Richard M. McAlexander, Sparks, all of Nev.

[73] Assignee: The United States of America as represented by the Secretary of the Interior, Washington, D.C.

[21] Appl. No.: 6,137

[22] Filed: Jan. 24, 1979

[51] Int. Cl.[2] ..... B03D 1/06

[52] U.S. Cl. ..... 209/167

[58] Field of Search ..... 209/166, 167

[56] References Cited

U.S. PATENT DOCUMENTS

| | | | |
|---|---|---|---|
| 1,445,989 | 2/1923 | Borcherdt | 209/166 |
| 1,662,633 | 3/1928 | Borcherdt | 209/166 |
| 2,038,400 | 4/1936 | Whitworth | 209/166 |
| 2,112,362 | 3/1938 | Gillson | 209/166 |
| 2,120,217 | 6/1938 | Harris | 209/166 |
| 2,362,432 | 11/1944 | Cohn | 209/166 |

FOREIGN PATENT DOCUMENTS

| | | | |
|---|---|---|---|
| 141827 | 11/1960 | U.S.S.R. | 209/166 |

*Primary Examiner*—Robert Halper

*Attorney, Agent, or Firm*—William S. Brown; Donald A. Gardiner

[57] ABSTRACT

Lanolin is employed as a modifier for froth flotation utilizing conventional collectors such as fatty acids, kerosene, and the like. Lanolin added to the system acts as a depressant which assists in the selectivity of the process for the desired mineral or inhibits the flotation of gangue materials. Scheelite ore flotation is substantially improved using lanolin in addition to a conventional collector such as tall oil.

3 Claims, No Drawings

FROTH FLOTATION USING LANOLIN MODIFIER

BACKGROUND OF THE INVENTION

The present invention relates to froth flotation of minerals.

Froth flotation is used for dressing or beneficiating ore at or near the mine site to produce one or more concentrates of valuable minerals. Particles of the ore are suspended in water in the presence of a collector chemical which renders the mineral particles air-avid and water-repellent. The ore particles are subjected to agitation and aeration and the mineral particles which are treated with the collector rise to the top of the vessel and become concentrated there in a froth or foam. In most cases, it is the desired mineral which rises to the top for collection as product. In some cases, however, the undesired minerals rise to the surface and the desired mineral is removed with water from the bottom of the vessel. An example of the latter system is glass-sand flotation where iron-bearing minerals are separated as froth and high grade silica values are removed from the bottom of the flotation vessel.

While froth flotation is by far the dominant process of mineral dressing in present use, there have been many attempts to improve the process, particularly in achieving more efficient or sharper separation. In particular, there have been developed many modifiers which, when added to the flotation systems, increase the selectivity of the collector for the mineral desired to be floated. This type of modifier is frequently referred to as a depressant. Examples of known depressants include quebracho, tannin or acidified sodium dichromate to depress calciferous minerals. With many ores, however, these depressants are not particularly successful in depressing troublesome gangue materials.

It is an object of the present invention to provide an improved method of froth flotation. It is a further object to provide an improved method of mineral concentration by froth flotation. It is a further object to provide an improved depressant for use in mineral froth flotation and it is a further object to provide an improved method of scheelite flotation using a novel depressant in conjunction with a conventional collector material.

BRIEF SUMMARY OF THE INVENTION

The foregoing and other objects which will be apparent to those of ordinary skill in the art are achieved in accordance with the present invention by utilizing lanolin as a depressant in conjunction with a conventional collector chemical in a froth flotation method. As in the conventional froth flotation method, particles of the ore are suspended in water in the presence of a collector chemical which renders the mineral particles air-avid and water-repellant. Lanolin is added as a depressant. The suspended particles are subjected to aeration and agitation in a vessel to form a layer of froth or foam containing the mineral which is desired to be floated in higher concentration than that in the ore remaining in the water.

The invention will be further understood with reference to the following detailed description of preferred embodiments.

DETAILED DESCRIPTION

The minerals to which the present invention is applicable include those minerals which are known to be effectively concentrated by froth flotation using a collector chemical. The valuable concentrates that are obtained may be either the froth or foam product that collects at the top of the froth flotation vessel, or the underflow product. For example, in the case of scheelite flotation as well as in the case of metallic sulfide ores of copper, lead, nickel, molybdenum and zinc, the valuable minerals become concentrated in the froth. In glass-sand flotation, iron-bearing minerals become concentrated in the froth while valuable silica becomes concentrated in the water remaining in the flotation vessel and is removed from the bottom of the flotation vessel.

A wide number of collectors are known in the art. In general, certain collectors are preferred for use with certain minerals for optimum performance. For example, xanthates and dithiophosphates are commonly used for flotation of metallic sulfides and native metals such as gold and silver. Crude or refined fatty acids and their soaps, tall oil, kerosene, and NFA (mixture of equal parts by weight of oleic acid and naphthenic acid) are used in flotation of scheelite. Crude or refined fatty acids and their soaps, petroleum sulfonates and sulfonated fatty acids are used in flotation of fluorspar, phosphate rock, iron ore and the like. Cationic collectors such as fatty amines and amine salts are used in flotation of quartz, potash and silicate minerals. Fuel oil and kerosene are used in flotation of coal, graphite, sulfur and molybednite.

The amount of collector which is used in the present invention is the amount normally used. While the usual amount will vary somewhat for particular collectors, in general, the collectors are used in an amount of from about 0.01 to 2 lbs. per ton of ore. In the case of xanthates and dithiophosphates, amounts of about 0.1 to 0.2 lbs./ton of ore are normally used. Fatty acids and the like are normally used in higher amounts on the order of 0.2 to 2 lbs./ton of ore and the amount of cationic collectors is generally intermediate, on the order of 0.1 to 1.0 lbs./ton of ore.

The flotation method and equipment of the present invention are conventional except for the use of the lanolin modifier. The process techniques and equipment are thoroughly described in the literature including trade literature which describes readily available equipment and supplies. In general, froth flotation is applicable to metallic ores normally ground finer than 48 to 65 mesh and to coal and other non-metallics ground finer than 10 to 28 mesh. The ore is suspended in water in a flotation vessel at a pulp density of, in general, about 15 to 35% solids, in the presence of a collector chemical which renders the mineral particles air-avid and water repellant. A layer of froth or foam forms at the top of the vessel due to the vigorous agitation and aeration which takes place. A frothing agent is usually employed to facilitate froth formation. Suitable frothers include aliphatic alcohols having 5–8 carbon atoms such as methylisobutyl carbinol and methyl amyl alcohol and pine oil, propylene glycol ether and cresylic acid. Various other conventional modifiers, such as activators, alkalinity regulators and dispersants or deflocculants may also be used. Activators are used to render the surface of a mineral acceptable to being coated with a collector. For example, copper ion is commonly used to activate sphalerite. Suitable alkaline regulators include lime, caustic soda, soda ash and sulfuric acid to control pH. Dispersants or deflocculants are used to control slimes. Conventional deflocculants include soda ash, lime, sodium silicate and lignin sulfonates.

As mentioned above, flotation equipment is widely available commercially. Frequently, one type of machine is used for roughing and another for cleaning. The machines provide mechanical agitation and aeration, commonly by means of a rotating impeller on an upright shaft. Some machines also employ aeration by means of a blower.

The collector chemical and lanolin modifier are added at any convenient time such as in the flotation vessel or during the preparation of the ground ore. Lanolin is a heterogeneous admixture of esters comprising water insoluble alcohols and higher fatty acids. The lanolin which is used in accordance with the invention may be crude or refined. Refining lightens the color of the crude lanolin and reduces odor and free fatty acid content.

The present invention is further illustrated in the examples which follows.

EXAMPLE 1

1,000 grams of epidote-chlorite ore containing 1.17 wt.% $WO_3$ are ground in laboratory ballmill to about 50 percent minus 400 mesh. 2.0 lb./ton (4 grams) of lime (CaO) are added to the ballmill. Ore is added to a Denver flotation machine and pulp density is adjusted to about 33 percent. The pH is 9.5 and temperature is 20° C. A sulfide flotation concentrate is recovered to remove pyrite, pyrrhotite and other sulfide minerals. Reagents added are 0.2 lb. Z-11 and 0.15 lb. Dowfroth 250. Conditioning time is 3 minutes followed by 3 or 4 minutes flotation time to recover sulfide concentrate. Rougher scheelite concentrate is prepared with the following additions and conditions: pH 9.5–10.5, add 4.0 lb./ton $Na_2CO_3$, 11.0 lb./ton $Na_2SiO_3$ (RU grade), 1.0 lb./ton tall oil, and 0.1 lb./ton Dowfroth 250, 0 to 2.0 lb./ton lanolin (see Table 1). The conditioning time is 5 minutes, followed by a 4 to 5 minute flotation period to recover rougher scheelite concentrate. Scavenger concentrate is prepared with the following reagents and conditions: 0.5 lb./ton lanolin. No lanolin is added in Run #1. Conditioning time of 5 minutes is followed by 3 or 4 minute flotation period to collect rougher concentrate.

The results from the series of five tests varying the quantity of lanolin added in the rougher float from 0 to 2.0 lbs./ton of ore are shown in Table 1. Other operating variables are held constant.

TABLE 1

Effect of Lanolin on Scheelite Flotation From Tactite Ore Containing 1.17 wt.-pct. $WO_3$

| Run No. | Lanolin lb./ton | Concentrate grade: $CO_3$, wt. % Rougher | Concentrate grade: $CO_3$, wt. % Scavenger | $WO_3$ recovery, % Rougher | $WO_3$ recovery, % Rougher Plus Scavenger |
|---|---|---|---|---|---|
| 1 | 0 | 10 | 0.5 | 82 | 92 |
| 2 | 0.5 | 14 | .4 | 93 | 99 |
| 3 | 1.0 | 24 | .5 | 84 | 94 |
| 4 | 1.5 | 28 | 1.8 | 84 | 96 |
| 5 | 2.0 | 33 | 20.0 | 77 | 85 |

Results shown in Table 1 indicate the grade of rougher concentrates increases as the quantity of lanolin is increased from 0.5 to 2.0 lb./ton. Recovery exceeds 90% for experiments containing up to 1.5 lb./ton lanolin. Recovery decreases to 85% for the 2.0 lb./ton lanolin run. The highest recovery in the rougher concentrate is made using 0.5 lb./ton lanolin.

EXAMPLE 2

1,000 grams of garnet-sphalerite ore containing 0.17 wt.% WO and 6.2 wt.% zinc are ground with 2.0 lb./ton CaO to about 50% minus 400 mesh. The ore is added to a Denver flotation machine and the pulp density is adjusted to 33%. The temperature is 20° C. and the pH is 9.5. A sulfide concentrate is prepared by adding 0.2 lb./ton Z-11 and 0.2 lb./ton Dowfroth 250. The conditioning time is 3 minutes followed by a flotation time of 4 to 5 minutes. A sphalerite concentrate is prepared by adding 0.2 lb./ton $CuSO_4$ and 0.2 lb./ton Z-200. The conditioning time is 5 minutes followed by a flotation time of 5 to 6 minutes. A rougher scheelite concentrate is prepared by adding 4.0 lb./ton $Na_2CO_3$, 11.0 lb./ton $Na_2SiO_3$ (RU grade) and 0.1 lb./ton Dowfroth 250. The quantities of collector and lanolin are shown in Table 2. The pH is 10 to 10.5 and the temperature is 20° C. The conditioning time is 5 minutes and the flotation time is 3–4 minutes. A scavenger scheelite concentrate is prepared by adding ½ of the collector and ½ of the lanolin used for the rougher concentrate. The conditioning time is 5 minutes and the flotation time is 3 to 4 minutes.

TABLE 2

The Effect of Lanolin On Scheelite Flotation From a Garnet-Sphalerite Ore Containing 0.17 wt. % $WO_3$

| Run No. | Lanolin, lb./ton | Collector, lb./ton | Rougher Concentrate grade: $WO_3$, wt. % | $WO_3$ recovery, % Rougher | $WO_3$ recovery, % Rougher Plus Scavenger |
|---|---|---|---|---|---|
| 1 | 0 | 0.5 tall oil | 7.0 | 75 | 87 |
| 2 | 0.25 | 0.5 tall oil | 11.0 | 81 | 89 |
| 3 | .50 | 0.5 tall oil | 13.0 | 75 | 86 |
| 4 | 1.0 | 0.5 tall oil | 10.3 | 73 | 84 |
| 5 | .5 | 0.5 tall oil .5 kerosene | 15.0 | 79 | 87 |
| 6 | .5 | .5 NFA | 6.4 | 77 | 83 |
| 7 | 1.0 | .5 NFA | 7.5 | 81 | 86 |
| 8 | .5 | .50 oleic | 13.3 | 66 | 84 |

Experimental results indicate that the grade of the rougher concentrate increases from 7 to as high as 13 wt.% $WO_3$ using 0.5 lb./ton lanolin and 0.5 lb./ton tall oil. Increasing the lanolin to 1.0 lb./ton results in a rougher concentrate containing 10.3 wt.% $WO_3$. Rougher concentrates containing 13.3 and 15.0 wt.% $WO_3$ are respectively recovered using 0.5 lb./ton lanolin with either 0.5 lb./ton oleic acid or 0.5 lb./ton tall oil plus 0.5 lb./ton kerosene. The combined recoveries in both rougher and scavenger concentrates are fairly consistent, varying from 83 to 89%. Comparable results are obtained using both Denver and WEMCO flotation cells, other variables being constant.

EXAMPLE 3

An electron beam microprobe and comprehensive chemical analysis are performed on scheelite flotation concentrates prepared with and without using lanolin. The ore used is epidote-chlorite ore containing 1.1 wt.% $WO_3$. Flotation conditions are the same as reported for experiments 1 and 3, Table 1. When lanolin is used, 1.0 lb./ton is added. Analysis is made of the rougher concentrates. The approximate % of calciferous minerals indicated by the microprobe, calculated in both wt.% and in grams, are shown in Table 3, for the calciferous minerals and other major constituents. The results in Table 3 show that lanolin depresses calcite and fluorite. Using wt.% as a standard, the calcite content is decreased by 50% and the fluorite content by 75%.

TABLE 3

Comparison of Mineral Contents of Concentrates Prepared With and Without Lanolin

| Mineral | Without lanolin wt. % | Without lanolin wt. g | 1.0 lb./ton lanolin wt. % | 1.0 lb./ton lanolin wt. g |
|---|---|---|---|---|
| $CaWO_4$ | 14.0 | 13.0 | 42.0 | 14.3 |
| $CaF_2$ | 2.6 | 2.4 | .6 | .2 |
| $CaCO_3$ | 68.0 | 63.3 | 31.0 | 10.5 |
| $SiO_2$ | 8.5 | 7.9 | 10.6 | 3.6 |
| $Al_2O_3$ | 2.1 | 2.0 | 2.6 | .9 |
| $Fe_2O_3$ | 3.2 | 3.0 | 4.6 | 1.6 |
| ZnS | .8 | .7 | 2.1 | .7 |
| Others | .8 | .7 | 6.5 | 2.2 |
| Total | 100.0 | 93.0 | 100.0 | 34.0 |

Using the actual weight of mineral floated as a standard, the weight of calcite was reduced to 1/6 and the weight of fluorspar was reduced to 1/12 of the weight obtained without lanolin.

In the foregoing examples, "Z-11" is a trade name for sodium isoproplyl xanthate;

"Dowfroth 250" is a trade name for a commercially available frother comprising polypropyleneglycol methyl ethers;

"Z-200" is a tradename for isoproysyl ethylthiocarbamate;

"NFA" is a tradename for a commercially available mixture of equal parts by weight of oleic acid and naphthenic acid; and "Lanolin" is U.S.P. hydrous lanolin produced by Stanlabs, Inc.

From the foregoing examples, it is apparent that the optimum amount of lanolin for scheelite flotation using conventional collectors is about 0.25 to 1.0 lb./ton. At that level, $WO_3$ recovery is near to 90% and concentrates containing over 20 wt.% are obtained. With conventional calciferous depressants, recoveries of 90% and concentrate grades over 10% are difficult to maintain. An excess of conventional calcite depressant such as quebracho or tannin depresses scheelite also. It is significant that lanolin alone does not function as a scheelite collector or frother. This is confirmed by experiments using lanolin alone. On the other hand, when used in conjunction with conventional collectors, lanolin acts as a very effective depressant.

What is claimed is:

1. In a method of concentrating scheelite by froth flotation in which particles of ore are suspended in water in the presence of a collector chemical which renders desired scheelite particles air-avid and water-repellent, in which the suspended particles are subjected to aeration and agitation in a vessel whereby a layer of froth forms at the top of the vessel, the concentration of the desired scheelite ore present in the froth being higher than that remaining in the water, the improvement wherein the concentration of the scheelite in the froth is increased by adding lanolin to the water in which the ore particles are suspended.

2. A method according to claim 1 wherein lanolin is added in an amount of from 0.01 to 2 lbs. per ton of mineral ore.

3. A method according to claim 1 wherein the concentrated mineral in the froth is removed from the vessel as product.

* * * * *